United States Patent [19]

Nealy

[11] 4,135,665

[45] Jan. 23, 1979

[54] INTEGRATED SEWAGE TREATMENT SYSTEM

[76] Inventor: Robert H. Nealy, C-11 Fox Run, Warminster, Pa. 18974

[21] Appl. No.: 775,805

[22] Filed: Mar. 9, 1977

Related U.S. Application Data

[63] Continuation-in-part of Ser. No. 477,539, Jun. 7, 1974, abandoned.

[51] Int. Cl.[2] ..... F23G 3/00; F24D 3/00; C02C 3/00

[52] U.S. Cl. ..... 237/8 R; 110/221; 110/233; 210/152; 237/81

[58] Field of Search ..... 210/152, 71; 237/81, 237/1 R, 56, 138 R; 110/8 C, 8 P, 10, 7 B, 15, 221, 233

[56] References Cited

U.S. PATENT DOCUMENTS

| | | | |
|---|---|---|---|
| 1,090,485 | 3/1914 | Lindmark | 60/648 |
| 3,171,387 | 2/1965 | Muller | 237/8 R X |
| 3,296,122 | 1/1967 | Karassik et al. | 21/56 X |
| 3,702,596 | 11/1972 | Winther | 110/15 X |
| 3,762,549 | 10/1973 | Crampton | 210/152 X |
| 3,926,743 | 12/1975 | Cynin | 60/648 X |

*Primary Examiner*—William E. Wayner
*Attorney, Agent, or Firm*—John J. Byrne; Edward E. Dyson

[57] ABSTRACT

An on-site system in which means for treating domestic sewage generated within a building located thereon are totally integrated with means for modifing space temperatures and for heating water for sanitary and other purposes therein to form a matrix of interrelated and interdependent functions acting together to deliver only non-polluting products to the environment and to achieve maximal energy conservation.

24 Claims, 1 Drawing Figure

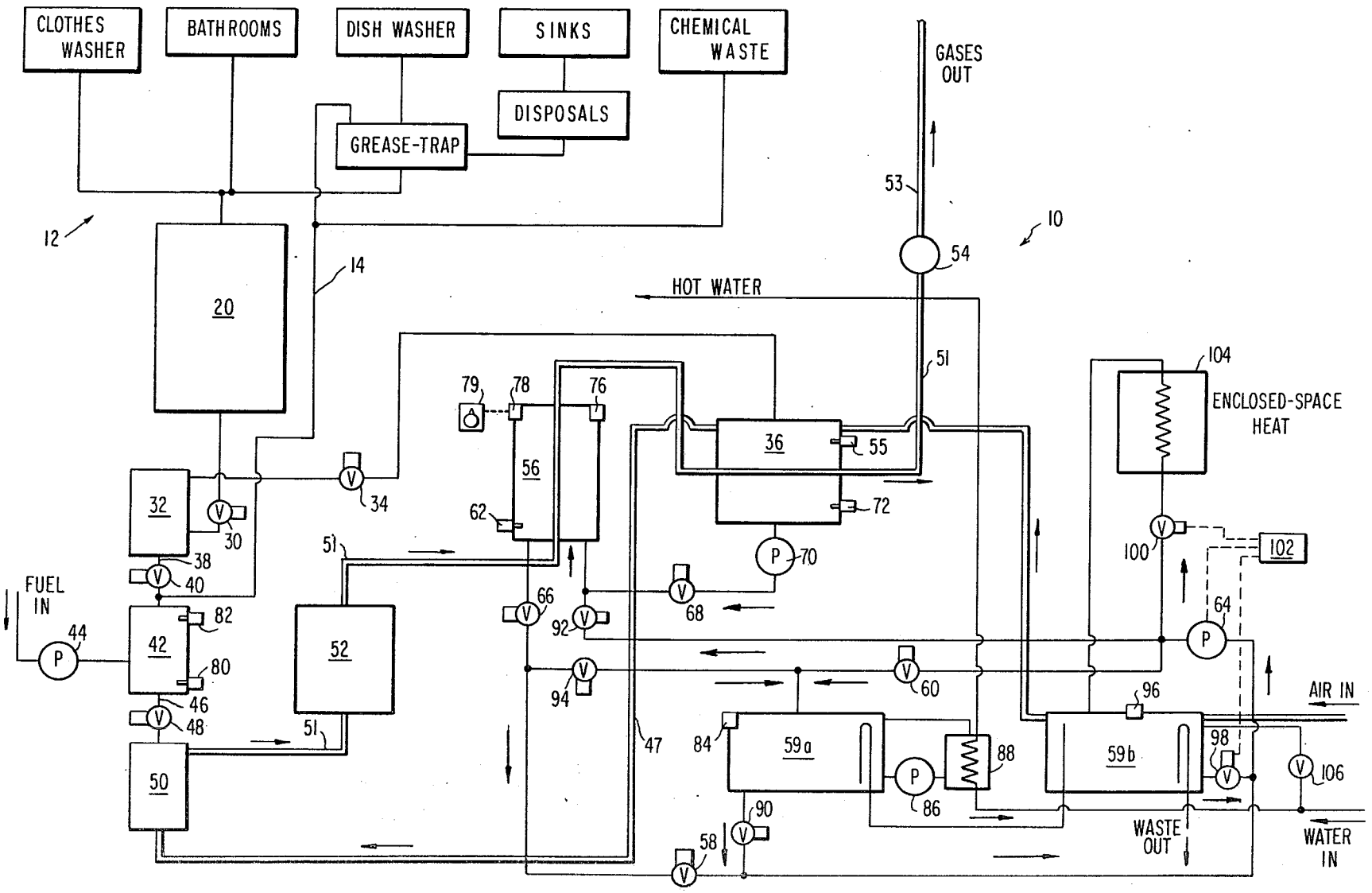
ENCLOSED-SPACE HEAT
AIR IN
WATER IN
WASTE OUT
GASES OUT
HOT WATER
CHEMICAL WASTE
SINKS
DISPOSALS
DISH WASHER
GREASE-TRAP
BATHROOMS
CLOTHES WASHER
FUEL IN
10
12
14
20
30
32
34
36
38
40
42
44
46
47
48
50
51
52
53
54
55
56
58
59a
59b
60
62
64
66
68
70
72
76
78
79
80
82
84
86
88
90
92
94
96
98
100
102
104
106

INTEGRATED SEWAGE TREATMENT SYSTEM

CROSS-REFERENCE TO RELATED APPLICATION

This application is a continuation-in-part of application Ser. No. 477,539, filed June 7, 1974, and abandoned subsequent to the filing of this application.

OBJECTIVES OF THE INVENTION

A principal objective of the invention is to provide communal protection against health hazard and aesthetically offensive emanations, independent of soil biology and the soil mechanics pertaining on the site which might originate in a building constructed and occupied thereon.

A further objective of the invention is to enhance the institutional reliability of the communal protection provided by utilizing only means which lend themselves to total automation and avoiding all techniques requiring that chemical reactants be added to the sewage treatment process.

Another important objective of the invention is to intrinsically bias the sewage treatment function in favor of being maintained in good working order by reciprocally integrating it with other functions normally construed as being essential within a building for the physical comfort and convenience of the occupants.

Another objective of the invention is to use the energy derivable from the combustible components of raw human excrement and from other combustible organic wastes normally associated with the processes of human living to produce a net reduction in the aggregate system demand for externally supplied commercial fuels or other sources of energy.

A further objective of the invention is to provide a system that is adaptable and convertible from time to time to the use of virtually any liquid solid or gaseous fuel, or the use of electrical power, as an acceptable source of externally supplied energy for system processes in order to ensure maximal operating economy as the prices of fuels and electrical power may fluctuate from time to time and from place to place.

Another objective of the invention is to provide for on-site treatment of human excrement wherein the energy demand for physical treatment of the liquid component thereof is reciprocally integrated with the energy demands of other functions normally existing and consistently used in the structure located on the site to the end that the aggregate system energy demand is reduced by multi-purpose employment.

Another objective of this invention is to provide a waste disposal system which can be used at sites not served by sewer and which converts building wastes into non-polluting gases and vapors for delivery to the atmosphere and relatively harmless water for delivery to the ground.

A still further objective of this invention is to provide a waste disposal system in which pressurized liquid-phase thermal sterilization of the waste takes place, resulting in a net decrease of the energy required to operate the system.

BACKGROUND OF THE INVENTION

As population throughout the world increases, the disposition of human waste materials becomes an increasingly vexing problem. In many instances, federal, local and state agencies have resorted to stringent restrictions on the methods employed to dispose of such waste.

In less densely populated areas, where the per capita costs of sewage collection and treatment systems are prohibitive, on-site septic tank systems have represented the preferred method of human waste disposal for many years. Unfortunately, septic systems require precise soil characteristics for satisfactory performance. If soil percolation rates are too high, pathogenic and other contaminants can be carried into the water table and thereby present a public health hazard. If percolation rates are too low, septic tank effluents can bubble to the surface and present many undesirable consequences. Where the water table is high or is seasonably or variably high, there have been cases where septic tanks have floated out of ground in response to seasonal variations.

For the foregoing and other reasons, public agencies in growing numbers are prohibiting the use of septic tank systems unless rigid sub-surface conditions can be demonstrated to exist at the proposed building site. Because of these standards, there are many otherwise desirable building sites which cannot be utilized for construction unless public sewage systems are installed. This is an eventuality which may not occur. This results in otherwise desirable property lying idle in the face of tremendous needs for more housing and other building construction. These needs are oftentimes relieved by the selection of less desirable properties having better soil conditions.

ADVANTAGES OF THE INVENTION

The system of this invention represents the concept of combining into a single automated system a sewerage treatment function and many building service functions normally accomplished by separate systems. The system also extracts energy from sewage solids and organic wastes by incineration and thereby produces a net reduction in the aggregate fuel demand for these functions. Preferably, the system employs pressurized, liquid-phase thermal sterilization to treat the liquid sewage.

While accomplishing the above benefits, the system of this invention presents only non-polluting and non-noxious gases to the atmosphere. The water presented to the soil is of a quality at least equal to that delivered by modern tertiary sewage treatment plants.

These and other advantages of the invention will become more apparent to those skilled in the art by reference to the following detailed description when viewed in light of the single accompanying drawing disclosing a schematic of the system.

DETAILED DESCRIPTION OF THE PRESENTLY PREFERRED EMBODIMENT

Illustrated in FIG. 1 is a system of vessels, filters, pumps, heat exchangers, valves, conduits and controls that are combined to accept raw sewage and organic garbage from a residence or other source and to process it in an improved manner. The wastes are physically separated into essentially solid-free liquids and wet solids. The wet solids are mixed with a supplementary fuel component and the mixture is incinerated. (The wastes and the fuel component are both fuels. Hereinafter, the mixture will be called the fuel slurry.)

The liberated energy of combustion is used to process the solid-free liquid so that all pathogenic organisms are destroyed by pressurized liquid-phase thermal sterilization. The energy is then taken from the hot effluent by means of heat exchangers and subsequently utilized for the heating or cooling of enclosed space and the heating of sanitary hot water. Relatively cool, odor-free, sterile and essentially solid-free effluent is delivered to the soil for absorption.

Referring now to the schematic wherein like elements are referred to by like numerals, the system as a whole is indicated by the numeral 10. The normal household appliances that process residential wastes are labeled as such in the drawing and are indicated as a group by the numeral 12. Chemical wastes and the sediment from the grease trap are separately collected into conduit 14.

A receiver vessel 20 is provided to accept the liquid and solid organic wastes from facilities 12. This receiver vessel is sized to permit storage during peak periods. The flow capacity of the system is rated to an average flow on a sixteen hour cycle of activity followed to the end of the day by eight hours of relative quiescence.

Raw wastes from vessel 20 are delivered through a normally open valve 30 to a filter 32. Filter 32 is of a design capable of filtering solids down to a size of less than 500 microns which is smaller than the largest sizes normally discharged in the effluent of a modern sewage treatment plant. The filtered liquid passes through a normally open valve 34 to an effluent collector 36. In the outlet conduit 38 from the filter 32 there is disposed a valve 40. Valve 40 is normally closed and will hold filtered solids in the filter 32 until activated.

On a pre-arranged signal, valve 30, in the conduit between the receiver 20 and the filter 32, closes and the valve 40 opens. The solids, together with a measured amount of water, pass to a slurry homogenizer 42. At this same time, a measured amount of fuel is introduced into homogenizer 42 by a fuel pump or delivery mechanism 44. The solids and liquid in homogenizer 42 are homogenized by mechanical agitation.

Upon receiving a second pre-arranged signal, this homogenized fuel and solid slurry is introduced into conduit 46 leading to burner 50. A valve 48 is disposed in conduit 46. The atmosphere in burner 50 is electrically and thermostatically controlled at a temperature level above the flash temperature of the slurry and is continuously supplied with ambient air by means of a gas duct system 47 which is driven by a centrifugal stack blower 54.

The gases developed during combustion in the burner 50 pass to a scrubber 52 where unreacted organic gases are completely oxidized to water and carbon dioxide. This is accomplished with the assistance of contact with an appropriate catalyst at an appropriate temperature. Inorganic gases, typically sulphur gases, are removed from the gas stream in the scrubber 52 by reaction with suitable chemical getters. The burner 50 and scrubber 52 can be of the type more fully described in the U.S. Pat No. 3,642,583 to Greenberg and the U.S. Pat. No. 3,647,358 to Greenberg, et al.

After scrubbing, the gases pass to a pressurized sterilizer 56 and thence to the aforementioned effluent collector 36. The two segments of gas duct 51 which transit through pressurized sterilizer 56 and effluent collector 36 are both gas-to-liquid heat exchangers. The gas therefrom passes to the stack 53 for discharge to the atmosphere.

As the sewage filtrate is accumulated in collector 36, evolution of dissolved gases is promoted by the secondary cooling of the burner stack gases and a consequent rise in filtrate temperature. Ammonia, carbon dioxide, and organic gases are carried to the burner 50, where the last-mentioned burns spontaneously in its supply air stream (see air conduit segment 47), which stream has transited across the liquid surface in collector 36. The temperature in burner 50 is high enough to decompose the ammonia into nitrogen and hydrogen and to ignite the hydrogen, which burns to water vapor.

When the filtrate level in the collector 36 rises to a pre-determined level, a collector high level control 55 is activated. Through appropriate control circuitry, an effluent sterilization sequence is established wherein the normally closed valves 58 and 60 are opened and operation of the sterile effluent pump 64 is initiated. The contents of the pressurized effluent sterilizer 56 are pumped to a first stage storage vessel **59*a* displacing an equal volume of liquid to the second stage storage vessel 59*b***.

A sterilizer low level control 62 of the sterilizer 56 is actuated initiating a second sequence wherein valves 58 and 60 are closed and the operation of pump 64 is terminated. The normally open valve 66 is closed and the normally closed valve 68 opens. The closing of valve 66 takes the first-stage storage thermostat 84 off alert, and the events it normally triggers will not occur while valve 66 is closed. Operation of the pathogenic effluent pump 70 is initiated and valve 34 closes. When the contents of the effluent collector 36 are completely pumped (via pum 70) to the pressurized effluent sterilizer 56, a collector low level control 72 is actuated and a third sequence step is initiated wherein valve 68 closes and operation of the pump 70 is terminated. Valve 34 is opened to allow resumption of flow to the effluent collector 36. One of the effluent sterilizer thermostats 76 is energized to thereby open valve 48 allowing fuel slurry to enter the burner 50, where the fuel-laden slurry ignites spontaneously.

In due course, the effluent temperature in the effluent sterilizer 56 reaches a sterilization level, and a thermostat 78 is actuated. This starts a sterilization timer 79. It is known that maintaining sewage at 300° F. for a period in excess of twenty minutes destroys all living organisms in water suspension, and the thermostat 78 and the sterilization timer 79 are preferably set at those values. During the sterilization sequence, the sterilizer thermostat 76 closes down burner 50 but remains ready to operate the burner intermittently during a sterilization hold period.

It should be particularly noted that, since the sterilizer 56 is a pressurized vessel, or autoclave, temperatures in excess of the atmospheric boiling temperature of water, such as the previously mentioned temperature of 300° F., can be achieved without the sewage's undergoing a phase change. This fact results in the pressurized liquid-phase thermal sterilization of the sewage, which is substantially more energy efficient than unpressurized thermal sterilization of sewage wherein a great deal of energy is wasted in converting the liquid to vapor.

It is possible that the fixed amount of fuel-slurry in the slurry homogenizer 42 will become depleted during the third sequence of steps. If there is a depletion, there will be an interruption in sterilizer heat-up or the sterilization temperature "hold period" which could potentially invalidate the sterilization process, if it were to proceed on a fixed time cycle. The supplementary fuel supply 44, however, is initiated independently of the effluent system control circuitry by a homogenizer low level control 80. When this occurs, interlocks (not shown) between the fuel supply system control circuitry and the effluent system control circuitry takes the sterilizer thermostat 76 (which is put on line by the opening of valve 90) off line, close valve 48 and re-set and hold the sterilization timer until completion of the supplementary fuel supply sequence. At that time, the effluent is brought back to sterilization temperature and the timer re-started.

During sterilizer heat-up, hold and discharge sequence, the collector high level control 55 is held on alert to close valve 34 and prevent a rise in fluid level in the collector 36 above a predetermined point. It is also ready to initiate a new sterilization sequence immediately upon completion of a previous one should this be indicated.

Upon completion of the sterilization hold period, the timer initiates a fourth sequence wherin the valves 66, 58 and 60 are opened, pressurized sterilizer 76 is taken off operating alert, and operation of pump 64 is initiated to pump the contents of the pressurized effluent sterilizer 56 to the first stage storage vessel 59*a*, at the completion of which the sterilizer low level control 62 terminates the sterilization sequence. The effluent system control is then placed on stand-by alert.

The sterile effluent pumped to the vessel 59*a* forms the source of energy for heating a supply of sanitary water. The effluent is pumped continuously by the heat exchanger pump 86 through an instantaneous water heater 88 close-coupled to the first stage storage vessel 59*a*.

Should the effluent temperature fall below a selected point while no sterilization sequence is in progress, a storage re-heat sequence is initiated by the first stage storage vessel thermostat 84. The normally closed valves 90, 92, 94 are opened and the operation of the sterile effluent pump 64 is started. The effluent temperature being below the control point of the effluent sterilizer thermostat 76 (which is placed on alert as part of the re-heat sequence), burner operation is initiated and circulation of first stage storage content is continued until thermostat 84 stops the sequence.

The second stage storage vessel 59*b* forms the source of energy for the enclosed-space heating function. This vessel receives its supply of energy from the high temperature effluent displaced from the first stage storage vessel 59*a*. The temperature of the effluent in the second stage storage 59*b* is controlled by the second stage storage thermostat 96 which is on alert at all times, whether or not the sterilization sequence is active. Upon demand from the second stage storage thermostat 96, normally closed valves 98 and 60 open and operation of pump 64 is initiated. Circulation to first stage storage 59*a* and return therefrom by displacement continues, independent of any other system functions, until the second stage storage selected temperature is restored. Supply air for the burner 50 initially transits across the liquid surface of the second stage storage 59*b* to insure removal of ammonia from the effluent prior to discharge.

Actuation of an enclosed-space thermostat 102 opens the normally closed valves 98 and 100 and initiates operation of pump 64. The pump continues to circulate heated effluent to the enclosed-space heat transfer system 104 until the enclosed-space thermostat setting is achieved or restored. This circulation is not interrupted by operation of any other system sequence.

For system start-up, valve 106 is opened manually and operation of the control system is initiated. All previously described sterile effluent system sequences will be triggered and in due course all components thereof will be filled with appropriately heated water at which time overflow to ground will occur from second stage storage 59*b* indicating that manual valve 106 is to be manually closed.

It should be noted that sterile effluent conduit circuitry is designed so that sterile effluent pump 64 can draw effluent through valves 58, 90, and 98 either individually or simultaneously in any combination and deliver through valves 60, 92, and 100 either individually or simultaneously, and the pumping capacity is sized accordingly.

In a general manner, while there has been disclosed as effective and efficient embodiment of the invention, it should be well understood that the invention is not limited to such an embodiment as there might be changes made in the arrangement, disposition, and form of the parts without departing from the principle of the present invention as comprehended within the scope of the accompanying claims.

I claim:

1. An integrated system for modification of the natural temperatures which would otherwise prevail within a building, for the heating of water as required for human purposes, and for treating of domestic sewage generated within said space to acceptable community disposal standards comprising
   - a vessel receiving the waste from an enclosed living space,
   - a filter dividing said waste into a liquid component and a slurry component,
   - a homogenizer receiving said slurry component,
   - a collector receiving said liquid component,
   - a unit receiving said liquid component from said collector,
   - a fuel source supplying pre-selected amounts of fuel to said homogenizer wherein said slurry and said fuel are caused to form a mixture,
   - a burner to incinerate said mixture and form high temperature gases,
   - means to transmit said high temperature gases through said unit to heat and sterilize said liquid component, and
   - heat transfer means for utilizing the heat from said liquid component for energy to energize integrated space temperature modification and water heating functions.

2. The system of claim 1 wherein a scrubber treats said high temperature gases prior to their transmission to said unit.

3. The invention of claim 2 wherein said scrubber includes means to eliminate deleterious gases from said high temperature gases.

4. The system of claim 1 wherein said heat transfer means includes first and second storage means to receive the liquid subsequent to its sterilization and prior to its disposal.

5. The system of claim 1 wherein said means includes a conduit system following a tortuous path through said unit.

6. The system of claim 1 wherein a thermostat is mounted to said unit, a timer is operatively connected to said thermostat and said timer is actuated by said thermostat to insure the sterilization of said liquid component by said high temperature gases.

7. The system of claim 1 wherein valving sequence means controls the flow of said fuel and said components.

8. An integrated system comprising, means to collect raw human excrement and other combustible organic wastes normally associated with processes of human living and dividing same into substantially solid-free liquid component and a slurry component, second means to raise the temperature of said slurry component to a temperature level above the flash temperature of said slurry, whereby high temperature gases are formed, third means to pass said high temperature gases through said liquid component in heat exchange relationship therewith, thereby sterilizing it, and fourth means to utilize the residual heat in the now sterilized liquid component to energize integrated space temperature modification and water heating functions.

9. The process of treating and utilizing human wastes comprising the steps of:

collecting the wastes in a container, dividing said wastes into a liquid component and a slurry component, raising the temperature of said slurry to a temperature level above the flash temperature of said slurry, thereby producing high temperature gases, passing said high temperature gases through said liquid component in heat exchange relationship therewith to heat and sterilize said liquid component, and transferring the heated liquid component for use to energize integrated enclosed-space temperature modification and water heating equipment.

10. An integrated system comprising:

(a) means to collect raw human excrement and other combustible organic wastes normally associated with processes of human living and dividing same into a substantially solid-free liquid component and a slurry component;

(b) second means to generate high temperature gases from said slurry by raising the temperature of said slurry to a temperature level above the flash temperature of said slurry;

(c) third means to thermally sterilize said liquid component by passing said high temperature gases through said liquid component in heat exchange relationship therewith; and (d) fourth means to utilize the residual heat in the now sterilized liquid component to energize integrated space temperature modification and water heating functions.

11. An integrated sewage treatment system comprising:

(a) first means for collecting domestic sewage composed of raw human excrement and other organic and inorganic wastes entrained in transport water;

(b) an autoclave wherein said sewage is subjected to pressurized liquid-phase thermal sterilization;

(c) second means for regeneratively utilizing the thermal energy contained in said sewage after sterilization to energize space temperature modification and water heating functions normally associated with human domestic life; and (d) third means for disposing of said sewage after its thermal energy has been utilized and depleted.

12. The system of claim 11 and further comprising fifth means for comminuting the insoluble solids entrained in said sewage prior to its thermal sterilization.

13. An integrated system comprising, means to collect raw human excrement and other combustible organic wastes normally associated with processes of human living and dividing same into substantially solid-free liquid component and a slurry component, second means to raise the temperature of said slurry component to a temperature level above the flash temperature of said slurry, whereby high temperature gases are formed, third means to pass said high temperature gases through said liquid component in heat exchange relationship therewith, thereby sterilizing it, and fourth means to utilize the residual heat in the now sterilized liquid component to energize at least one other thermally motivated household function.

14. An integrated system as recited in claim 13 wherein said fourth means energizes space-temperature modification.

15. An integrated system as recited in claim 13 wherein said fourth means energizes water heating functions.

16. The process of treating and utilizing human wastes comprising the steps of:

collecting the wastes in a container, dividing said wastes into a liquid component and a slurry component, raising the temperature of said slurry to a temperature level above the flash temperature of said slurry, thereby producing high temperature gases, passing said high temperature gases through said liquid component in heat exchange relationship therewith to heat and sterilize said liquid component, and transferring the heated liquid component for use to energize equipment related to at least one other thermally motivated household function.

17. The process recited in claim 16 wherein the heated liquid component is transferred for use in energizing integrated enclosed-space temperature modifications.

18. The process recited in claim 16 wherein the heated liquid component is transferred for use in energizing water heating equipment.

19. An integrated sewage treatment system comprising:

(a) first means for collecting domestic sewage composed of raw human excrement and other organic and inorganic wastes entrained in transport water;

(b) second means for liquid-phase sterilization of said sewage;

(c) third means for regeneratively utilizing the thermal energy contained in said sewage after sterilization to energize at least one other thermally motivated function normally associated with human domestic life; and (d) fourth means for disposing of said sewage after its thermal energy has been utilized and depleted.

20. As integrated system as recited in claim 19 wherein said third means energizes space-temperature modification.

21. An integrated system as recited in claim 19 wherein said third means energizes water heating functions.

22. An integrated sewage treatment system comprising:

(a) first means for collecting domestic sewage composed of raw human excrement and other organic and inorganic wastes entrained in transport water;

(b) second means for subjecting said sewage to pressurized liquid-phase sterilization.

(c) third means for regeneratively utilizing the thermal energy contained in said sewage after sterilization to energize at least one other thermally motivated household function; and (d) fourth means for disposing of said sewage after its thermal energy has been utilized and depleted.

23. An integrated system as recited in claim 22 wherein said third means energizes space-temperature modification.

24. An integrated system as recited in claim 22 wherein said third means energizes water heating functions.

* * * * *